United States Patent [19]

Hastedt et al.

[11] Patent Number: 4,943,392

[45] Date of Patent: Jul. 24, 1990

[54] CONTAINING BUTOXY-PROPANOL WITH LOW SECONDARY ISOMER CONTENT

[75] Inventors: Charlene M. Hastedt, Fairfield; Ralph F. Medcalf, Jr., West Chester; Geneva G. Otten, Loveland, all of Ohio

[73] Assignee: The Procter & Gamble Company, Cincinnati, Ohio

[21] Appl. No.: 346,964

[22] Filed: May 5, 1989

Related U.S. Application Data

[63] Continuation-in-part of Ser. No. 202,732, Jun. 3, 1988, abandoned.

[51] Int. Cl.[5] ..... C11D 3/065; C11D 3/44

[52] U.S. Cl. ..... 252/539; 252/170; 252/171; 252/558; 252/DIG. 14; 252/173

[58] Field of Search ..... 252/153, 170, 171, 173, 252/90, 539, 540, 174.21, DIG. 14

[56] References Cited

U.S. PATENT DOCUMENTS

| | | | |
|---|---|---|---|
| 3,882,038 | 5/1975 | Clayton et al. | 252/164 |
| 4,152,306 | 5/1979 | DeMatteo | 252/539 |
| 4,362,638 | 12/1982 | Caskey et al. | 252/90 |
| 4,530,781 | 7/1985 | Gipp | 252/546 |
| 4,769,172 | 9/1988 | Siklosi | 252/153 |

FOREIGN PATENT DOCUMENTS

| | | |
|---|---|---|
| 82/88168 | 10/1983 | Australia . |
| 80749 | 6/1983 | European Pat. Off. . |
| 57-000200 | 1/1982 | Japan . |
| 2160887A | 1/1986 | United Kingdom . |
| 2166153A | 4/1986 | United Kingdom . |

*Primary Examiner*—Prince E. Willis

*Attorney, Agent, or Firm*—Robert B. Aylor; Richard C. Witte

[57] ABSTRACT

Aqueous detergent compositions containing butoxypropanol with a low level of the "secondary" isomer have improved odor characteristics with a variety of perfume compositions even when the compositions contain other typical cosolvents. Preferred compositions include hard surface cleaners having good filming and streaking properties. The compositions contain a detergent surfactant and, desirably, a detergent builder.

6 Claims, No Drawings

CONTAINING BUTOXY-PROPANOL WITH LOW SECONDARY ISOMER CONTENT

CROSS-REFERENCE TO RELATED APPLICATION

This is a continuation-in-part of commonly assigned, copending application for IMPROVED LIQUID CLEANERS, U.S Ser. No. 07/202,732, filed June 3, 1988, now abandoned.

TECHNICAL FIELD

This invention relates to liquid detergent compositions. In particular, it relates to aqueous detergent compositions suitable for use as general purpose household cleaning compositions.

BACKGROUND

Attention is directed to the liquid detergent compositions disclosed in Australian Pat. Application 82/88168, filed Sept. 9, 1982, by The Procter & Gamble Company; U.K. Pat. Application GB 2,166,153A, filed Oct. 24, 1985, by The Procter & Gamble Company; and U.K. Pat. Application GB 2,160,887A, filed June 19, 1985, by Bristol-Myers Company, all of said published applications being incorporated herein by reference. These liquid detergent compositions comprise certain organic solvents, surfactant, and optional builder and/or abrasive. The prior art, however, fails to teach, or recognize, the advantage of the specific organic solvent herein in a liquid cleaner formulation.

General purpose household cleaning compositions for hard surfaces such as metal, glass, ceramic, plastic and linoleum surfaces, are commercially available in both powdered and liquid form. Powdered cleaning compositions consist mainly of builder or buffering salts such as phosphates, carbonates, silicates, etc. Such compositions display good inorganic soil removal, but they can be deficient in cleaning ability on organic soils such as the calcium and/or magnesium salts of fatty acids, commonly called soap scum or bathtub soil, and greasy/fatty/oily soils typically found in the domestic environment Liquid cleaning compositions have the great advantage that they can be applied to hard surfaces in neat or concentrated form so that a relatively high level of surfactant material and organic solvent is delivered directly to the soil. Moreover, it is a rather more straightforward task to incorporate high concentrations of anionic or nonionic surfactant in a liquid rather than a granular composition. For both these reasons, therefore, liquid cleaning compositions have the potential to provide superior soap scum, grease, and oily soil removal over powdered cleaning compositions.

Nevertheless, liquid cleaning compositions still suffer a number of drawbacks which can limit their consumer acceptability. Thus, they frequently contain little or no detergency builder salts and consequently they tend to have poor cleaning performance on particulate soil and also lack "robustness" at high water hardness levels. In addition, they can suffer problems of product form, in particular, inhomogeneity, lack of clarity, or inadequate viscosity characteristics, or excessive "solvent" odor for consumer use. The odor problems are made more acute by the higher in-product and in-use surfactant concentrations necessary for improved grease handling, and the consumers' typical habit of diluting the cleaning compositions with hot, or very warm, water which increases the vapor pressure of volatile components.

It has now been determined that a particular butoxy propanol solvent is preferred for odor reasons in liquid cleaners.

SUMMARY OF THE INVENTION

According to the present invention there is provided an aqueous liquid detergent composition comprising:

(a) from about 0.1% to about 40% of detergent surfactant;

(b) from about 0.5% to about 25% of butoxypropanol in which no more than about 20%, preferably less than about 10%, most preferably less than about 7% is the "secondary" isomer (2-butoxy-propanol) in which the butoxy group is attached to the secondary carbon atom of the propanol;

(c) from about 0% to about 30% of detergency builder; and (d) at least about 50% water, said composition being packaged aged in a container that is not adapted to create a spray.

DETAILED DESCRIPTION OF THE INVENTION

It has now been discovered that some of the odor defects of prior art liquid cleaning compositions can be minimized or overcome through the incorporation therein of a specific butoxypropanol solvent. This solvent has superior odor acceptance as compared to other solvents and to a butoxy-propanol solvent which contains higher levels of the "secondary" isomer. The solvent also has the ability to provide excellent cleaning characteristics across a range of water hardness and/or greasy/oily soils and inorganic particulate soils, as well as to enhance the cleaning contribution of other ingredients, e.g., the detergent surfactant and detergent builders, on marker ink, bathtub soil, calcium soap scum, etc., and excellent shine performance with low soil redeposition and little or no propensity to cause filming, streaking or spotting on surfaces washed therewith.

The present invention thus provides excellent liquid detergent compositions which provide excellent shine performance together with improved cleaning characteristics both on greasyoily soils and on inorganic particulate soils with little tendency to cause filming or streaking on washed surfaces, and which have importantly preferred odors.

Aqueous liquid cleaners are used full strength or in further dilution in water by the consumer to clean a wide variety of hard surfaces.

The uses for such cleaning liquids are too numerous to be specified completely, but such liquids are useful for cleaning of counter tops, painted surfaces, walls, floors, appliance exterior surfaces, tables, chairs, windows, mirrors, and so forth. It is understood that terms like $C_8$–$C_{18}$ alkyl benzene sulfonate include singular compounds, as well as mixtures thereof.

THE DETERGENT SURFACTANT

First, such liquid cleaners contain from about 0.1% to about 40% of suitable detergent surfactant. Successively more preferred ranges of surfactant inclusion are from about 1% to about 10% of surfactant, and from about 2% to about 5% of surfactant. Broadly, the surfactants useful for formulation of aqueous liquid cleaners are the usual ones for hard surface cleaners. Some specific surfactants are those in the broad surfactant disclosure of U.S. Pat. No. 4,287,020, Siklosi, issued Sept. 1, 1981, incorporated herein by reference in its entirety.

The detergent surfactant falls into the following classes: anionic, cationic, nonionic, zwitterionic and amphoteric surfactants. This is taken from Col. 4 of U.S. Pat. No. 4,287,080, Siklosi, incorporated by reference hereinbefore.

Preferred surfactants for use in such cleaners are one or more of the following: sodium linear $C_8$–$C_{18}$ alkyl benzene sulfonate (LAS), particularly $C_{11}$–$C_{12}$ LAS; the sodium salt of a coconut alkyl ether sulfate containing 3 moles of ethylene oxide; the adduct of a random secondary alcohol having a range of alkyl chain lengths of from 11 to 15 carbon atoms and an average of 2 to 10 ethylene oxide moieties, several commercially available examples of which are Tergitol 15-S-3, Tergitol 15-S-5, Tergitol 15-S-7, and Tergitol 15-S-9, all available from Union Carbide Corporation; the sodium and potassium salts of coconut fatty acids (coconut soaps); the condensation product of a straight-chain primary alcohol containing from about 8 carbons to about 16 carbon atoms and having an average carbon chain length of from about 10 to about 12 carbon atoms with from about 4 to about 8 moles of ethylene oxide per mole of alcohol; an amide having one of the preferred formulas:

$$R-\overset{\overset{\displaystyle O}{\|}}{C}-N(R^1)2$$

wherein R is a straight-chain alkyl group containing from about 7 to about 15 carbon atoms and having an average carbon chain length of from about 9 to about 13 carbon atoms and wherein each $R^1$ is a hydroxy alkyl group containing from 1 to about 3 carbon atoms; a zwitterionic surfactant having one of the preferred formulas in the broad surfactant disclosure above; or a phosphine oxide surfactant having one of the preferred formulas in the broad disclosure of semipolar nonionic surfactants. Another preferred class of surfactants is the fluorocarbon surfactants, examples of which are FC-129, a potassium fluorinated alkylcarboxylate and FC-170-C, a mixture of fluorinated alkyl polyoxyethylene ethanols, both available from 3M Corporation, as well as the Zonyl fluorosurfactants, available from DuPont Corporation. It is understood that mixtures of various surfactants may be used. An especially preferred surfactant for use herein is the sodium salt of linear $C_{11}$–$C_{12}$ alkyl benzene sulfonate (LAS).

For many purposes, synthetic (e.g., nonsoap) detergent surfactants are desirable.

BUTOXY-PROPANOL

A second essential ingredient of aqueous liquid cleaners of the present invention is 0.5% to 25%, preferably 1% to 15%, of butoxy-propanol (mono butyl ether of propylene glycol) that contains no more than about 20%, preferably no more than about 10%, more preferably no more than about 7% of the "secondary" isomer in which the butoxy group is attached to the secondary carbon atom of the propanol, i.e., 1-hydroxy-2-butoxy-propanol. The preferred isomer is the one in which the butoxy group is attached to the primary carbon of propylene glycol (1-hydroxy-1-methyl-2-butoxyethane). A major commercial source of butoxy-propanol which was available heretofore contained about one third of the "secondary" isomer.

The butoxy-propanol solvent containing only small amounts of the "secondary" isomer provides an effective liquid, aqueous detergent composition with improved odor as compared to compositions containing more "secondary" isomer or other conventional organic solvents like Butyl Carbitol®. The odor of the improved butoxy-propanol is still not sufficiently improved to permit compositions containing it to be sprayed. i.e., the composition should not be packaged in a container that is adapted to create a spray. Excessive volatilization, such as occurs when a composition is sprayed, has been shown, by actual consumer experience, to create an unacceptable odor, even with compositions containing the improved butoxy-propanol defined herein. Ordinary perfumes do not cover the residual butoxy-propanol odor when the compositions are sprayed.

The odor advantage of the improved butoxy-propanol is seen with many perfumes, and even when other organic solvents are present. Compositions containing these "primary" isomers have a "brighter" or "cleaner" smell. The solvent enhances perfumes even in the presence of other solvents, especially less volatile solvents. Accordingly, mixtures of butoxy-propanol and other solvents such as butoxypropoxypropanol or butyldiglycol, which are less volatile, are desirable since the impact of any particular odor is less.

Most perfumes are compatible with the low "secondary" isomer compositions including the popular pine and citrus (lemon) perfumes.

The levels of the "secondary" isomer in the composition should be less than about 5%, preferably less than about 3%, more preferably less than about 1%.

THE PERFUME

Perfume compositions are preferably used at a level of from about 0.01% to about 5%, more preferably from about 0.1% to about 4%, and for some compositions more preferably from about 0.2% to about 2% by weight of the composition. The effect of the butoxy-propanol is to enhance the perfume odor making it "brighter" or "cleaner." The exact basis for this effect is not known, but is independent of perfume type. The enhancement is of a nature that is compatible with the intended use of the compositions, i.e., cleaning.

Examples of perfume compounds and compositions that are useful can be found in U.S. Pat. Nos.: 4,145,184, Brain and Cummins, issued Mar. 20, 1979; 4,515,705, Moeddel, issued May 7, 1985; and 4,152,272, Young, issued May 1, 1979, all of said patents being incorporated herein by reference.

The perfumes that are typically used include citrus, pine, floral, spice, etc., perfumes. Other perfume types can be used as well when the odor is consistent with the desired end use. Citrus and pine are especially desirably for hard surface cleaners.

DETERGENT BUILDER

A third desirable component of the aqueous liquid cleaners of the present invention is from 0% to about 30%, preferably from about 1% to about 15%, more preferably from about 1% to about 12%, of detergent builder. While any of the builders or inorganic salts may be used herein, the preferred builders for use herein are sodium nitrilotriacetate, potassium pyrophosphate, potassium tripolyphosphate, sodium or potassium ethane-1-hydroxyl-1,1-diphosphonate, the nonphosphorous chelating agents described in the copending U.S. Pat.

Application of Culshaw and Vos, Ser. No. 177,708, filed Apr. 5, 1988, said application being incorporated herein by reference (e.g., carboxymethyltartronic acid, oxydimalonic acid, tartrate monosuccinic acid, oxydisuccinic acid, tartrate disuccinic acid, and mixtures thereof), sodium citrate, sodium carbonate, sodium sulfite, sodium bicar.bonate, and so forth. Most preferred builders for use herein are sodium carbonate, sodium bicarbonate, tetrapotassium pyrophosphate, sodium tartrate monosuccinic acid and mixtures thereof with tartrate disuccinic acid, sodium nitrilotriacetate, sodium N-(diethylene-glycol)-iminodiacetate, and sodium N-(2-hydroxypropyl)-iminodiacetate, and the like, sodium sulfite, as well as mixtures of these preferred materials. Potassium pyrophosphate, sodium carbonate, and sodium citrate are preferred builders and are preferably used at a level of from about 1% to about 15%.

THE OPTIONALS

An optional ingredient which is sometimes highly desirable in aqueous liquid cleaners is a hydrotrope which serves to stabilize the compositions by aiding in the solubilization of their components. From about 0.1% to about 12% of the hydrotroping agent is used, particularly in compositions with less soluble diols or higher amounts of diols. The hydrotroping agent is selected from the group consisting of alkali metal, ammonium, and triethanolammonium isopropylbenzene sulfonates, xylene sulfonates, toluene sulfonates, benzene sulfonates, 5 (or 6)-carboxy-4-hexyl-2-cyclo-hexane-1-octanoic acid available from Westvaco Corporation, and mixtures thereof. Specific hydrotroping agents found to be useful herein are sodium cumene sulfonate and potassium toluene sulfonate.

Other cosolvents that can be used include: butoxypropoxypropanol, butyl diglycol (Butyl Carbitol®), hexyl diglycol (Hexyl Carbitol®), butyl triglycol, and mixtures thereof. The level of cosolvent is typically from about 0.2%, to about 20%, preferably from about 1% to about 15%, more preferably from about 2% to about 10%. The ratio of butoxy-propanol to cosolvent should be more than about 1:10, preferably more than about 1:4.

In many applications it will be highly desirable to incorporate a suds suppressor as an optional ingredient in the aqueous liquid cleaners herein. The purpose of this ingredient is to eliminate the need to repetitively rinse a surface after it is washed in order to remove all visible traces of the surfactant. The composition should contain about 1% or less of the suds suppressor, if it is used. One example is the sodium or potassium salt of a coconut fatty acid. Another example of a suitable suds suppressor is a surfactant which is the condensation product of a straight-chain random secondary alcohol having a chain length of from about 11 to about 15 carbon atoms and having an average length of from about 12 to about 15 carbon atoms with from about 1 to about 3 moles of ethylene oxide.

The balance of the composition (50% to 98%) is water, preferably soft water in order to minimize the initial load on the sequestering builders.

Further discussions of the requirements and formulation of aqueous liquid cleaners are found in U.S. Pat. Nos. 4,287,080, Siklosi, supra; 3,679,608, Aubert et al., issued July 25, 1972; and 3,970,594, Claybaugh, issued July 20, 1976. The foregoing three patents are incorporated herein by reference.

All percentages, parts, and ratios herein are by weight unless otherwise specified.

The following examples are illustrative of the present invention. All of the compositions are packaged in conventional packages that are not adapted to create a spray.

EXAMPLE I

| Component | A Wt. % | B Wt. % | C Wt. % |
|---|---|---|---|
| Sodium LAS ($C_{12}$ benzene sulfonate) | 2.0 | 5.0 | 2.0 |
| Coconut Fatty Acid | 1.0 | 1.0 | 1.0 |
| Sodium Carbonate | 1.5 | 2.0 | 2.0 |
| Sodium Bicarbonate | 1.0 | 1.0 | 1.0 |
| Tetrapotassium Pyrophosphate | 11.0 | 8.0 | 10.0 |
| Sodium Sulfite | 0.2 | 0.2 | 0.3 |
| Sodium Cumene Sulfonate | 6.0 | 5.0 | 6.5 |
| Ammonia | 1.0 | — | — |
| Monoethanolamine | 0.5 | 0.5 | — |
| Minors (perfume, color, etc.) | 2.0 | 1.9 | 2.0 |
| Butoxypropoxypropanol | — | 7.0 | 2.0 |
| Butoxy-Propanol (<7% "secondary" isomer) | 10.0 | 2.0 | 1.0 |
| Soft Water | Balance | Balance | Balance |

The materials above are combined and stirred until dissolved.

| Component | Wt. % |
|---|---|
| Sodium LAS ($C_{12}$ benzene sulfonate) | 2.0 |
| Coconut Fatty Acid | 1.0 |
| Sodium Carbonate | 1.5 |
| Sodium Bicarbonate | 1.0 |
| Tetrapotassium Pyrophosphate | 11.0 |
| Sodium Sulfite | 0.2 |
| Sodium Cumene Sulfonate | 6.0 |
| Ammonia | 1.0 |
| Minors (perfume, color, etc.) | 2.0 |
| Butoxy-Propanol (<7% "secondary" isomer) | 5.0 |
| Butoxypropoxypropanol | 5.0 |
| Soft Water | Balance |

The materials above are combined and stirred until dissolved.

EXAMPLE III

| Component | Wt. % |
|---|---|
| Sodium LAS ($C_{12}$ benzene sulfonate) | 3.0 |
| Coconut Fatty Acid | 0.5 |
| Sodium Carbonate | 2.0 |
| Sodium Bicarbonate | 2.0 |
| Sodium Citrate | 8.0 |
| Sodium Sulfite | 0.2 |
| Sodium Cumene Sulfonate | 5.0 |
| Ammonia | 1.0 |
| Minors (perfume, color, etc.) | 2.0 |
| Butoxy-Propanol (<7,% "secondary" isomer) | 2.0 |
| Butyl Carbitol ® | 9.5 |
| Soft Water | Balance |

The materials above are combined and stirred until dissolved.

What is claimed is:

1. An aqueous liquid detergent composition comprising:

(a) from about 0.1% to about 40% of detergent surfactant;

(b) from about 0.5% to about 25% of butoxypropanol containing less than about 20% of secondary isomer;

(c) from 0% to about 30% of detergency builder; and (d) at least about 50% water, said composition being packaged in a container that is not adapted to create a spray.

2. The composition of claim 1 wherein the surfactant is anionic.

3. The composition of claim 1 comprising:

(a) from about 1% to about 5% of sodium alkyl ($C_8$–$C_{18}$) benzene sulfonate surfactant;

(b) from about 1% to about. 15% of said butoxypropanol (b);

(c) from about 1% to about 15% tetrapotassium pyrophosphate builder; and (d) from about 0.1% to about 4% perfume composition.

4. The composition of claim 1 wherein the surfactant is a mixture of anionic and nonionic types.

5. The composition of claim 1 additionally comprising from about 0.2% to about 20% of cosolvent selected from the group consisting of: butoxypropoxypropanol, butyl diglycol, butyl triglycol, hexyl diglycol, and mixtures thereof.

6. The composition of claim 1 containing from about 0.01% to about 5% perfume composition.

* * * * *

UNITED STATES PATENT AND TRADEMARK OFFICE

CERTIFICATE OF CORRECTION

PATENT NO. : 4,943,392

DATED : July 24, 1990

INVENTOR(S) : Charlene M. Hastedt; Ralph F. Medcalf, Jr.; and Geneva G. Otten

It is certified that error appears in the above-identified patent and that said Letters Patent is hereby corrected as shown below:

TITLE PAGE:

[54] Title: "CONTAINING BUTOXY-PROPANOL WITH LOW SECONDARY ISOMER CONTENT" should read -- IMPROVED LIQUID CLEANERS CONTAINING BUTOXY-PROPANOL WITH LOW SECONDARY ISOMER CONTENT --.

Col. 1, lines 1-2, "CONTAINING BUTOXY-PROPANOL WITH LOW SECONDARY ISOMER CONTENT" should read -- IMPROVED LIQUID CLEANERS CONTAINING BUTOXY-PROPANOL WITH LOW SECONDARY ISOMER CONTENT --.

Col. 2, line 22, after "packaged" delete -- aged --.

Col. 5, line 7, "bicar.bonate," should read -- bicarbonate, --.

Col. 6, line 29, insert -- EXAMPLE II --.

Col. 7, line 2, "20%" should read -- 7% --.

Signed and Sealed this

Fifteenth Day of September, 1992

*Attest:*

*Attesting Officer*

DOUGLAS B. COMER

*Acting Commissioner of Patents and Trademarks*